US006163963A

United States Patent [19]

Huang

[11] Patent Number: 6,163,963

[45] Date of Patent: Dec. 26, 2000

[54] UTILITY KNIFE

[76] Inventor: Yin Han Huang, P.O. Box 63-99, Taichung 406, Taiwan

[21] Appl. No.: 09/291,176

[22] Filed: Apr. 14, 1999

[51] Int. Cl.[7] ..... B26B 1/08

[52] U.S. Cl. ..... 30/162; 30/335

[58] Field of Search ..... 30/162, 335, 2, 30/329, 340; D8/20

[56] References Cited

U.S. PATENT DOCUMENTS

| | | | |
|---|---|---|---|
| 2,948,961 | 8/1960 | Ortner | 30/162 |
| 3,593,417 | 7/1971 | West | 30/125 |
| 5,121,544 | 6/1992 | Gilbert | 30/162 |
| 5,303,469 | 4/1994 | Yin-Han | 30/2 |
| 5,435,062 | 7/1995 | Huang | 30/125 |
| 5,813,121 | 9/1998 | Gringer | 30/162 |
| 5,862,596 | 1/1999 | Chung | 30/162 |
| 5,864,952 | 2/1999 | Chung | 30/162 |
| 5,950,311 | 9/1999 | Huang | 30/162 |

*Primary Examiner*—Rinaldi I. Rada

[57] ABSTRACT

A utility knife includes a knife holder slidably received in the front portion of two casings. The front portions of the casings are hooked together. A knob is pivotally coupled to one of the casings and includes one end biased to engage with the other casing. A spring is engaged between the rear portions of the casings for biasing the rear portions of the casings away from each other when the knob is disengaged from the other casing and for allowing the casings to be easily separated from each other by the user.

5 Claims, 2 Drawing Sheets

UTILITY KNIFE

BACKGROUND OF THE INVENTION

1. Field of the Invention

The present invention relates to a utility knife, and more particularly to a utility knife having two separate casing secured together.

2. Description of the Prior Art

Typical utility knives comprise a housing including two casings secured together by latches and catches and/or by pivot shafts. U.S. Pat. Nos. 5,303,469 and 5,435,062 were developed by the applicant and disclosed two such typical utility knives each having two housing members secured together. However, once the latches are released, the casings or the housing members may not be automatically separated from each other such that the housing members may not be easily separated from each other by the users.

The present invention has arisen to mitigate and/or obviate the afore-described disadvantages of the conventional utility knives.

SUMMARY OF THE INVENTION

The primary objective of the present invention is to provide a utility knife having two casings that may be separated from each other by spring members when the latches are released or actuated.

In accordance with one aspect of the invention, there is provided a utility knife comprising a first casing and a second casing each including a rear portion and each including a front portion, a holder received in the front portions of the first casing and the second casing, means for hooking the front portions of the first casing and the second casing together, a knob pivotally coupled to the rear portion of the first casing at a pivot shaft and including a first end for engaging with the rear portion of the second casing, means for biasing the first end of the knob to engage with the rear portion of the second casing, and means for biasing the rear portions of the first casing and the second casing away from each other when the first end of the knob is disengaged from the rear portion of the second casing.

The first casing and the second casing each includes a notch formed in the rear portion thereof for receiving the knob and for preventing the knob from being depressed inadvertently. The first casing includes a bar extended from the rear portion of the first casing, the knob is pivotally coupled to the bar at the pivot shaft. The second casing includes a jut formed on the rear portion of the second casing for engaging with the first end of the knob and for allowing the knob to lock the first casing and the second casing together.

The first casing includes a stop extended from the rear portion of the first casing, the knob includes a second end for engaging with the stop and for limiting a rotational movement of the knob relative to the first casing and the second casing.

The front portions of the first casing and the second casing include a channel formed therein for slidably receiving the holder, and means for securing the holder to the first casing and the second casing. The first casing includes at least one recess formed in the front portion of the first casing, the blade holder includes an arm extended rearward therefrom, the arm includes a button extended outward of the first casing and the second casing and includes a catch for engaging with the recess of the first casing and for positioning the blade holder in place.

The first casing includes an aperture formed therein, the blade holder includes an extension extended therefrom for engaging into the aperture of the first casing and to secure the blade holder to the first casing when the first casing and the second casing are disengaged from each other.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
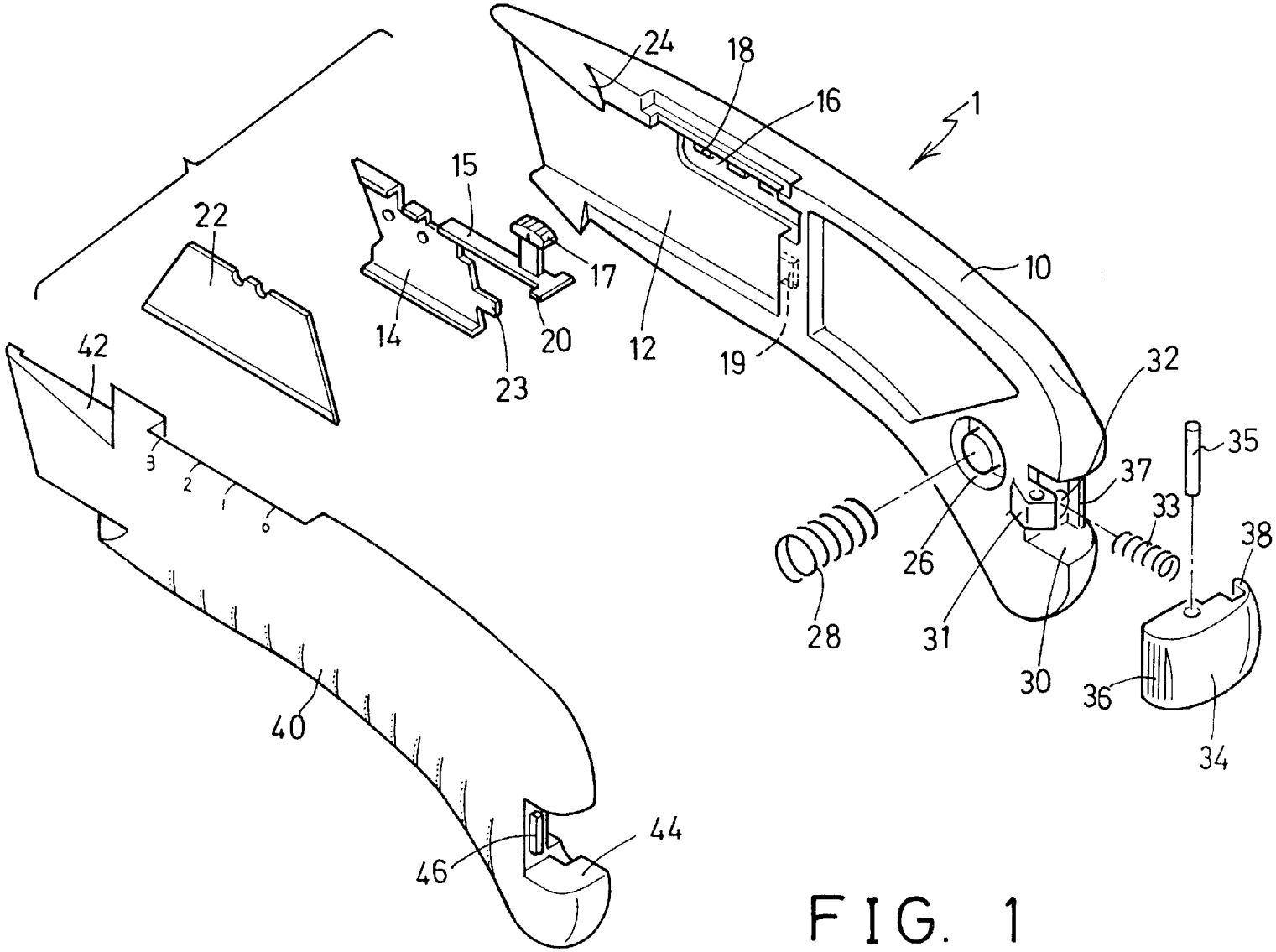
FIG. 1 is an exploded view of a utility knife in accordance with the present invention.
Figure 2:
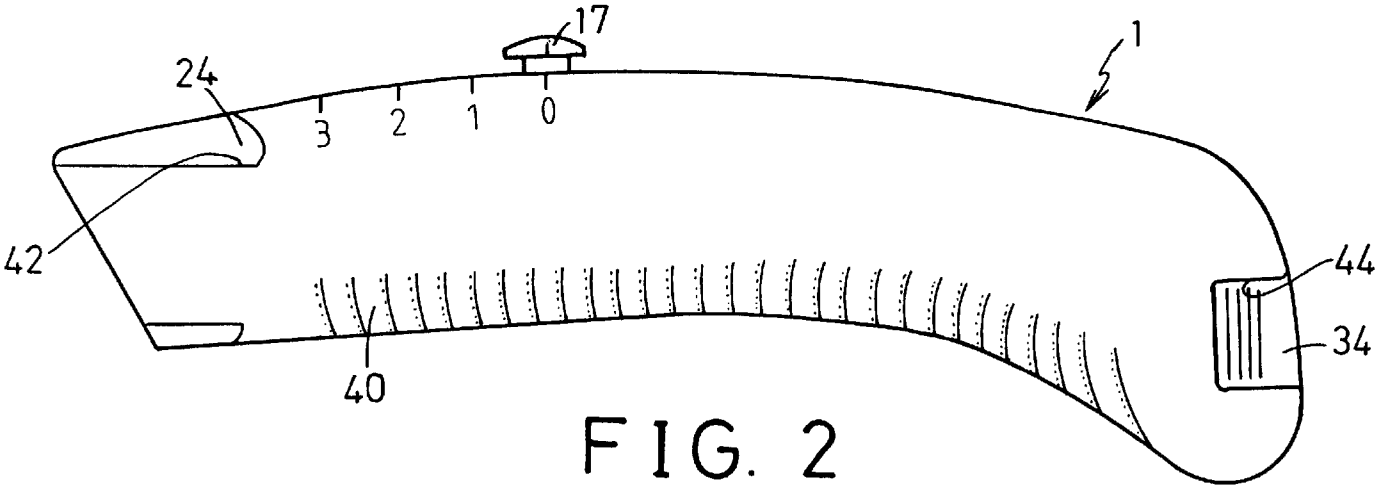
FIG. 2 is a plane view of the utility knife.
Figure 3:
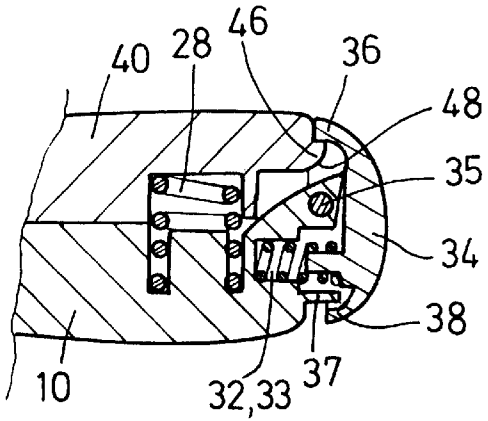
FIG. 3 is a cross sectional view taken along the rear end portion of the utility knife.

Referring to the drawings, and initially to FIGS. 1–3, a utility knife in accordance with the present invention comprises a housing 1 including two casings 10, 40 having a channel 12 formed in the front portion for slidably receiving a holder 14 of a blade 22. The casing 10 includes one or more recesses 16 formed in the front portion and defined by one or more bulges 18. The blade holder 14 includes a resilient arm 15 extended rearward and having a button 17 extended upward and outward of the housing 1 for allowing the user to move the blade 22 inward and outward of the housing 1. The arm 15 includes a catch 20 for engaging with the recesses 16 of the casing 10 and for securing the holder 14 to the casing 10. The holder 14 may be moved relative to the housing 1 when the catch 20 is disengaged from the recesses 16 of the casing 10 by the button 17 until the catch 20 is engaged with the other recesses 16 of the casing 10. The outward movement of the blade 22 relative to the housing 1 may thus be determined by the engagement between the catch 20 and the recesses 16 of the casing 10. The holder 14 includes an extension 23 for engaging into an aperture 19 of the casing 10 and for stably securing the holder 14 to the casing 10 when the holder 14 is moved inward of the housing 1.

Figure 4:
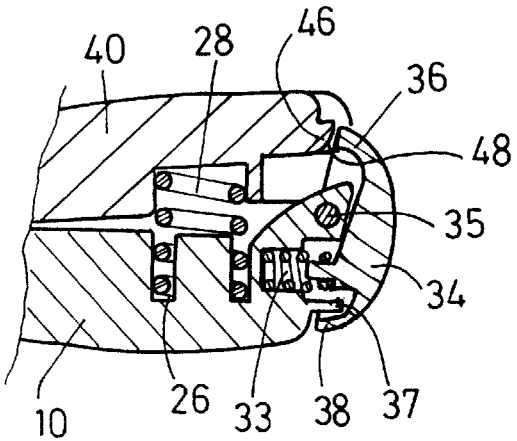
FIG. 4 is a cross sectional view similar to FIG. 3, illustrating the operation of the utility knife.

The casing 40 includes a depression 42 formed in the front portion, and the other casing 10 includes a hook 24 for engaging with the depression 42 of the casing 40 and for detachably securing the front portion of the casings 10, 40 together and for allowing the rear portions of the casings 10, 40 to be moved away from each other for a small distance (FIG. 4). Alternatively or relatively, the casing 40 may include a hook for engaging with the corresponding depression of the casing 10. The casings 10, 40 each includes a notch 30, 44 formed in the rear portion and each includes a hole 26 formed in the rear portion for receiving a spring 28 which may bias the casings 10, 40 away from each other. The casing 40 includes a jut 46 extended inward of the notch 44 thereof. The casing 10 includes a bar 31 extended inward of the notch 30 thereof and includes a hold 32 for receiving one end of a spring 33. A knob 34 includes a middle portion pivotally secured to the bar 31 at a pivot shaft 35 and includes one end 36 that may be biased to engage with the jut 46 of the casing 40 by the spring 33 (FIG. 3) and to lock the casing 10, 40 together. The other end 38 of the knob 34 may engage with a stop 37 that extends inward of the notch 30, for limiting the rotational movement of the knob 34.

In operation, as shown in FIG. 3, the spring 33 may bias the end 36 of the knob 34 to engage with the jut 46 of the casing 40 and to lock the casings 10, 40 together. The spring 28 apply a biasing force between the casings 10, 40 for further locking the casings 10, 40 in place. When the other end 38 of the knob 34 is depressed against the spring 33 to disengage the end 36 of the knob 34 from the jut 46 of the casing 40 (FIG. 4), the spring 28 may bias the rear portion of the casing 40 away from the casing 10 such that the user may easily separate the casings 10, 40 away from each other. The spring 33 may force the end 36 of the knob 34 to engage with the jut 46, and the spring 28 may relatively force the jut 46 to engage with the end 36 of the knob 34, such that the casings 10, 40 may be solidly locked together.

It is preferable that the jut 46 includes a curved surface 48 (FIGS. 3, 4) facing the casing 10, for allowing the jut 46 to easily move over and to engage with the end 36 of the knob 34 when the rear portion of the casing 40 is forced toward the rear end of the casing 10. The end 36 of the knob 34 may thus move over and engage with the jut 46 to lock the casings 10, 40 together without depressing the knob 34. As shown in FIG. 2, the knob 34 is received in the notches 30, 44 of the casing 10, 40 and thus will not be depressed or actuated inadvertently. Without the bar 31, the knob 34 may also be directly and pivotally coupled to the casing 10.

Accordingly, the utility knife in accordance with the present invention includes two casings that may be separated from each other by spring members when the latches are released or actuated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A utility knife comprising:

a first casing and a second casing each including a rear portion and each including a front portion, said first casing and said second casing each including a notch formed in said rear portion thereof, said first casing including a bar extended from said rear portion thereof;

a holder receiver in said front portions of said first casing and said second casing;

means for hooking said front portions of said first casing and said second casing together;

a knob received in said notches of said first and said second casings for preventing said knob from being depressed inadvertently, said knob including a middle portion pivotally coupled to said bar of said first casing at a pivot shaft, said knob including a first end for engaging with said rear portion of said second casing;

means for biasing said first end of said knob to engage with said rear portion of said second casing; and means for biasing said rear portions of said first casing and said second casing away from each other when said first end of said knob is disengaged from said rear portion of said second casing.

2. The utility knife according to claim 1, wherein said second casing includes a jut formed on said rear portion of said second casing for engaging with said first end of said knob and for allowing said knob to lock said first casing and said second casing together.

3. The utility knife according to claim 1, wherein said first casing includes a stop extended from said rear portion of said first casing, said knob includes a second end for engaging with said stop and for limiting a rotational movement of said knob relative to said first and said second casings.

4. The utility knife according to claim 1, wherein said front portions of said first casing and said second casing include a channel formed therein for slidably receiving said holder, means for securing said holder to said first casing and said second casing, said first casing includes at least one recess formed in said front portion of said first casing, said blade holder includes an arm extended rearward therefrom, said arm includes a button extended outward of said first casing and said second casing and includes a catch for engaging with said at least one recess of said first casing and for positioning said blade holder in place.

5. The utility knife according to claim 1, wherein said first casing includes an aperture formed therein, said blade holder includes an extension extended therefrom for engaging into said aperture of said first casing and to secure said blade holder to said first casing when said first casing and said second casing are disengaged from each other.

* * * * *